US008485557B2

(12) United States Patent
Zarley

(10) Patent No.: US 8,485,557 B2
(45) Date of Patent: Jul. 16, 2013

(54) SELF-SUPPORTING BOOK

(75) Inventor: Kermit Zarley, Scottsdale, AZ (US)

(73) Assignee: Kermit Zarley Enterprises, Scottsdale, AZ (US)

( * ) Notice: Subject to any disclaimer, the term of this patent is extended or adjusted under 35 U.S.C. 154(b) by 74 days.

(21) Appl. No.: 12/862,208

(22) Filed: Aug. 24, 2010

(65) Prior Publication Data

US 2011/0049859 A1 Mar. 3, 2011

Related U.S. Application Data

(63) Continuation-in-part of application No. 12/548,825, filed on Aug. 27, 2009.

(60) Provisional application No. 61/263,133, filed on Nov. 20, 2009.

(51) Int. Cl.

| | |
|---|---|
| ***B42D 3/00*** | (2006.01) |
| ***B42D 1/00*** | (2006.01) |
| ***B42D 5/00*** | (2006.01) |
| ***A47B 23/00*** | (2006.01) |
| ***B42F 3/00*** | (2006.01) |
| ***B42F 13/12*** | (2006.01) |
| ***B42F 13/00*** | (2006.01) |

(52) U.S. Cl.
USPC ..... 281/33; 281/151.1; 402/70; 402/73; 402/502

(58) Field of Classification Search
USPC ..... 281/15.1, 33; 402/70, 73, 80 P, 502
See application file for complete search history.

(56) References Cited

U.S. PATENT DOCUMENTS

| | | | | |
|---|---|---|---|---|
| 2,258,282 | A * | 10/1941 | Ericson | 281/33 |
| 2,617,665 | A * | 11/1952 | Ericson | 281/33 |
| 4,880,327 | A * | 11/1989 | Sanabria | 281/33 |
| 6,749,228 | B2 * | 6/2004 | Takemura | 281/33 |
| 2005/0001420 | A1 * | 1/2005 | Gordon | 281/33 |

* cited by examiner

*Primary Examiner* — Dana Ross
*Assistant Examiner* — Justin V Lewis
(74) *Attorney, Agent, or Firm* — Zarley Law Firm, P.L.C.

(57) ABSTRACT

A book has a front cover having a first edge which is unconnected, and an opposing second edge which is connected to a spine. A back cover has a first edge which is connected to the spine and an opposing second edge which is connected to flexible joint or fold-line. The book has a third cover having a first edge which is connected to flexible joint and an opposing second edge which is connected to binding which contains pages and a stabilizing sheet.

1 Claim, 15 Drawing Sheets

SELF-SUPPORTING BOOK

CROSS REFERENCE TO RELATED APPLICATION

This application claims the benefit of U.S. Provisional Application No. 61/263,133 filed Nov. 20, 2009 which is a continuation-in-part of U.S. patent application Ser. No. 12/548,825 filed Aug. 27, 2009.

BACKGROUND OF THE INVENTION

This invention relates to a book. More specifically, and without limitation, this invention relates to a self-supporting book.

Traditional books are well known in the art and generally comprise a plurality of pages positioned between a front cover and a back cover which are connected by way of a binding therebetween. These books are convenient for reading and studying when held in a reader's hands or placed in their lap, but are difficult to hold open when placed on a flat surface due to the bindings. More specifically, these books often have stiff bindings which involuntarily change pages or close the book altogether if a user's hand or other object is not present on the book to hold the book open.

To address these issues various designs were introduced to prop the book up. In particular, one design had a folding member which folded under the book perpendicular to the binding. Although this arrangement propped the book up, the folding member weakened the cover and the binding. Additionally, this arrangement lacked the necessary structural rigidity to support the book in a sturdy manner.

Additional designs have mating tabs with opposing hook & loop portions allowing the user to prop the book up at various angles. This design also has deficiencies as the connection does not provide sufficient structural rigidity. Also, the hook and eye arrangement has a tendency to interfere with the user's clothing.

Therefore, a need exists in the art for a book that addresses these deficiencies.

Thus an object of the present invention is to provide a book that is capable of being propped up in a secure manner.

Another object of the present invention is to provide a cover arrangement which allows a user to easily display the pages of the book.

Yet another object of the present invention is to provide a hands-free book that, when opened, is capable of being propped up in a secure manner with lay-flat pages.

These and other objects, features, or advantages of the present invention will become apparent from the specification and claims.

BRIEF SUMMARY OF THE INVENTION

A book has a front cover having a first edge which is unconnected, and an opposing second edge which is connected to a spine that wraps around the book's binding. A back cover has a first edge which is connected to the spine and an opposing second edge which is connected to flexible joint or fold-line. The book has a third cover having a first edge which is connected to a flexible joint and an opposing second edge which is connected to binding which contains pages and a stabilizing sheet.

DETAILED DESCRIPTION OF THE PREFERRED EMBODIMENT

A traditional book measures longer from top to bottom, called its "height," than it does from side to side, called its "width." All embodiments described herein present a book in which the book's binding and spine extend the height of the book, on one side or the other; yet the indicia on the pages of these embodiments is disclosed as being in the horizontal (landscape) position so that the book is propped in the horizontal position as well. This arrangement not only provides a long spine for viewing on the bookshelf, but also the horizontal propped position is most stable. However, all such embodiments described herein can accommodate the binding and spine being placed along the width of the book instead of its height, wherein such a book would have its binding at the top and open from the top, its indicia would be oriented on the pages would be placed as in a traditional book, and such a book would be propped in the vertical position.

Figure 1:
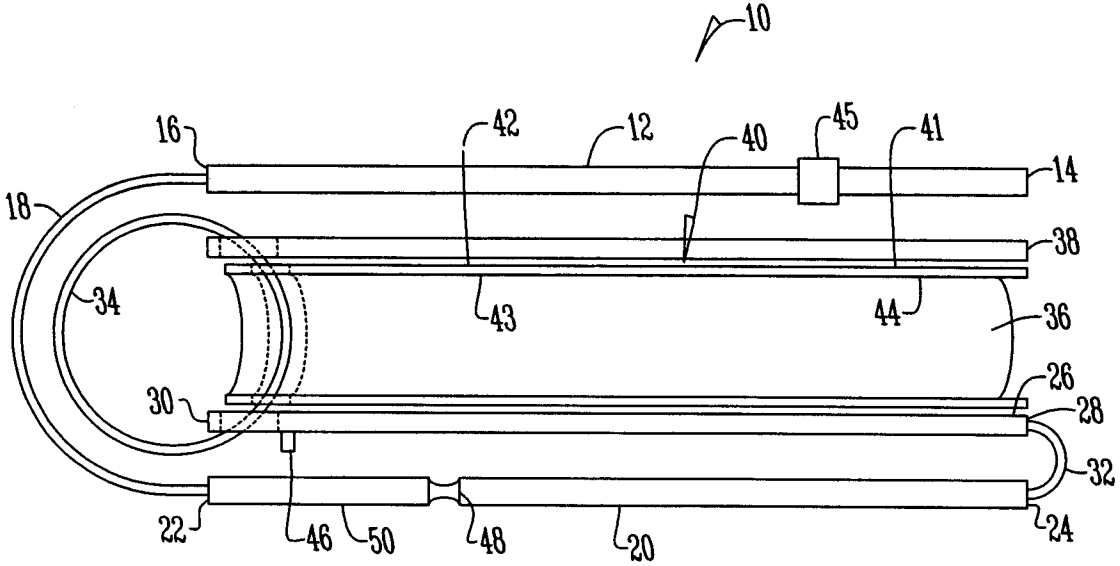
FIG. 1 is an elevational view of a book in a closed position.
Figure 2:
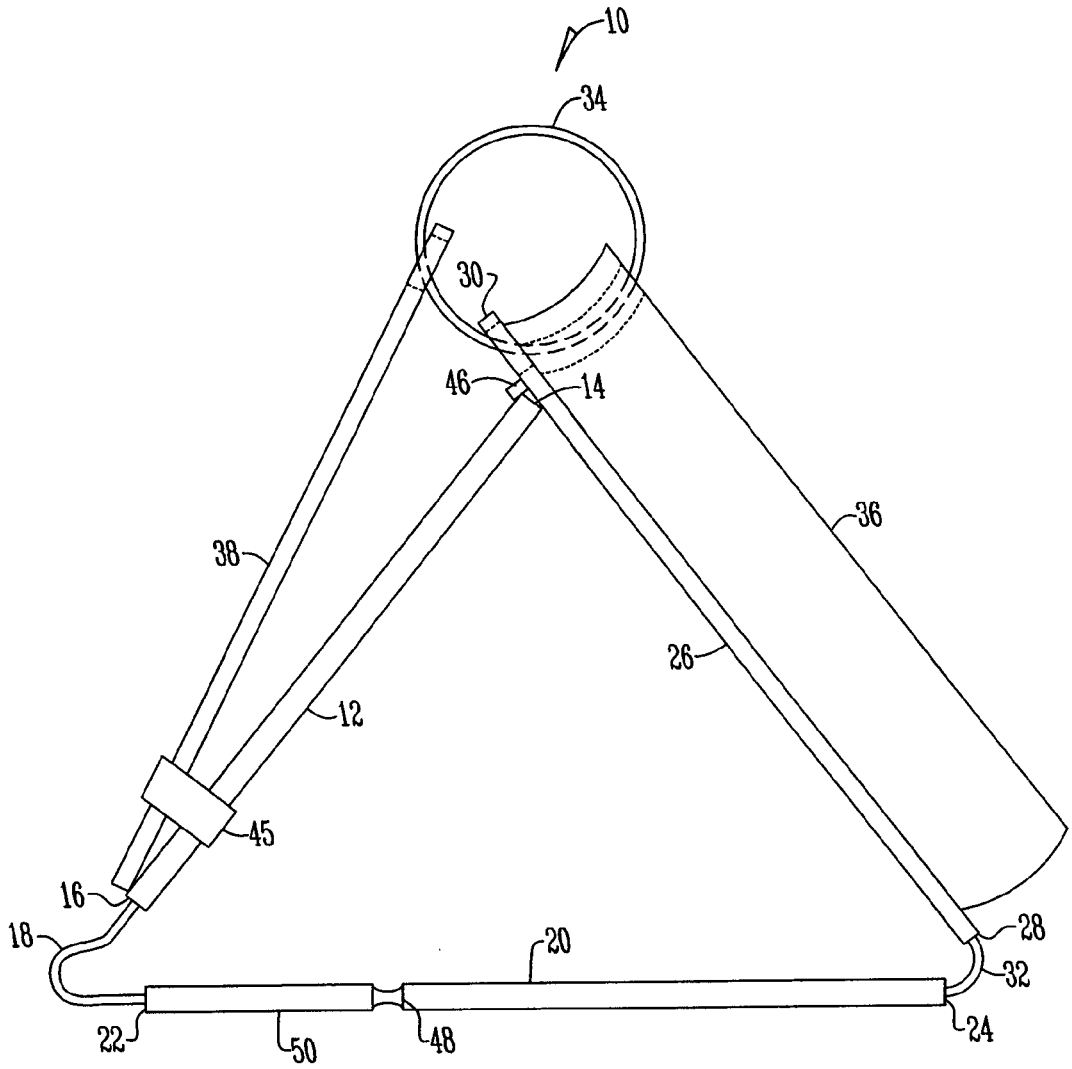
FIG. 2 is an elevational view of a book in a propped-up position.
Figure 3:
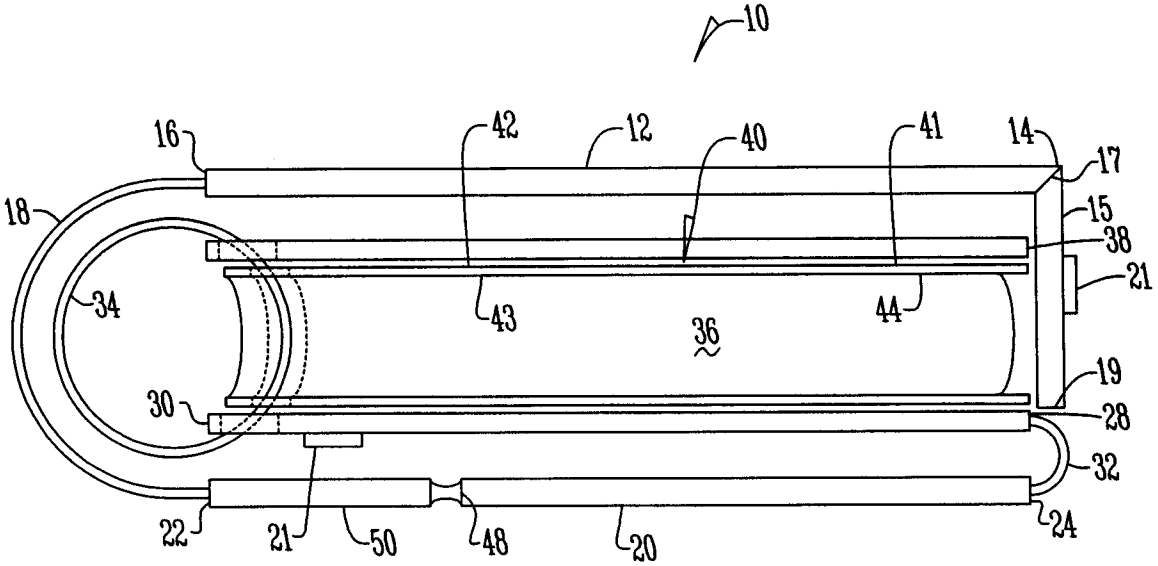
FIG. 3 is an elevational view of an alternate embodiment of a book in a closed position.
Figure 4:
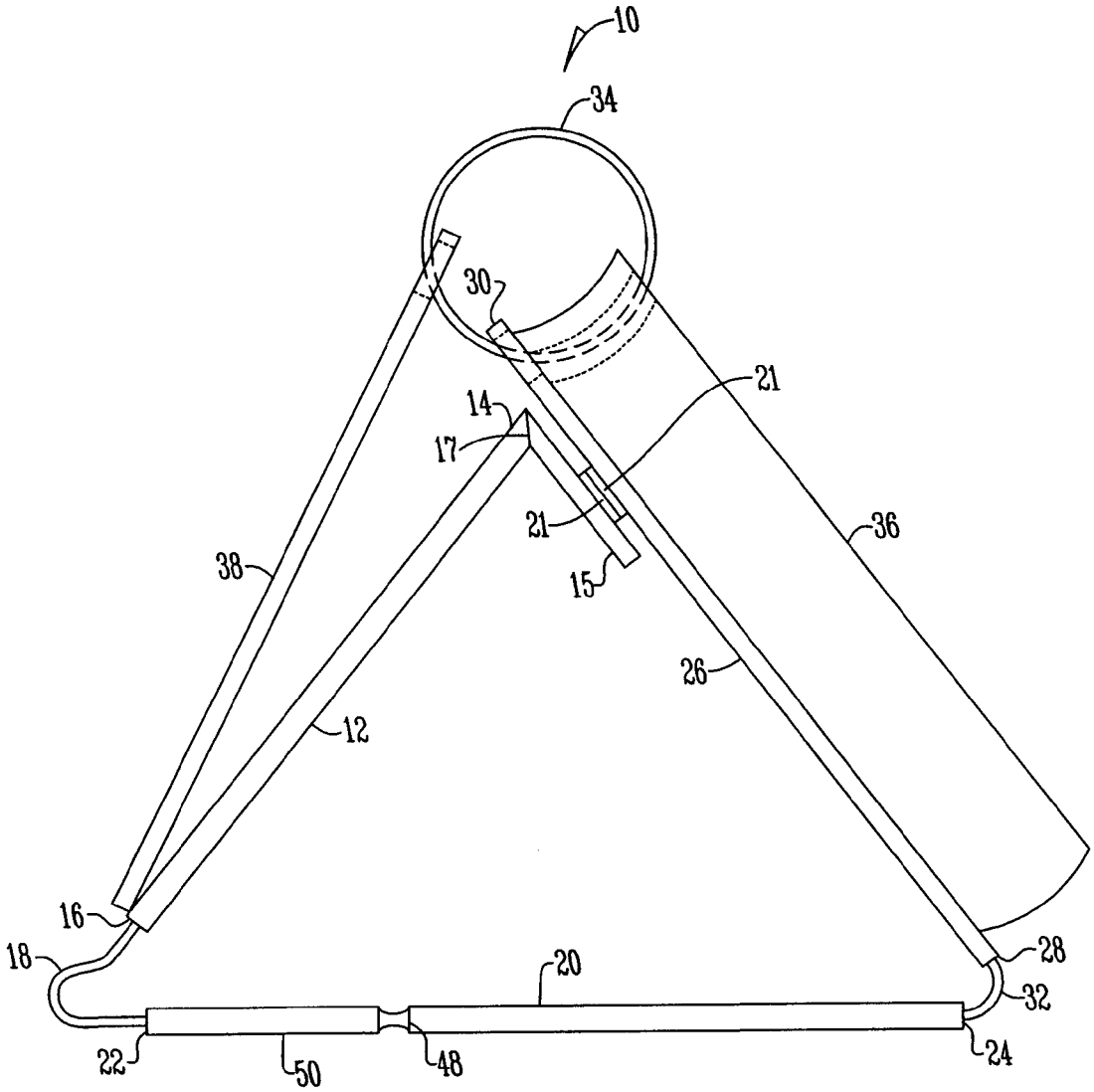
FIG. 4 is an elevational view of an alternate embodiment of a book in a closed position.

Referring to FIGS. 1 and 2, a book 10 has a front cover 12 with a first outer edge 14 and a second inner edge 16. The inner edge 16 of the front cover 12 is connected to a spine 18. A back cover 20 has an inner edge 22 and an outer edge 24 and is connected to the spine 18 along the inner edge 22.

A third cover 26 has a first inner edge 28 and a second outer edge 30. The first inner edge 28 of the third cover 26 is connected to the outer edge 24 of the back cover 20 along fold-line 32 by any conventional manner.

Connected to the outer edge of the third cover 26 is a binding 34. The binding 34 is of any type such as a spiral, comb, rings, twin wire, double loop, or the like. Preferably, the binding is an O-wire. Attached to the binding is a plurality of pages 36 and a stabilizing sheet 38. The stabilizing sheet 38 preferably made of plastic and generally is the same size as the pages and is positioned on top of the pages 36 and away from the third cover 26. Preferably, stabilizing sheet is thicker, denser and heavier than a page 36 so as to provide the necessary strength, weight and support.

The pages 36 contain printed indicia 40. While the indicia is printed in any format, preferred is that the indicia be printed two column, double sided on a horizontal plane such that pages one, two, three, and four follow the order shown in the Figures by reference numerals 41, 42, 43 and 44 respectively.

In a closed position, the third cover 26 sits on top of the back cover 20 and the pages 36 and stabilizing sheet 38 are positioned between the front cover 12 and the third cover 26. In this position the spine wraps around the book's binding, connecting it but not connected to it. To move to a propped position, the front cover 12 is folded outwardly along the spine away from the stabilizing sheet 38 and the third cover 26 is folded outwardly away from the back cover 20. Once folded outwardly, the outer edge 14 of the front cover 12 is moved inwardly and the outer edge 30 and binding 34 of the third cover 26 are moved inwardly such that the outer edge 14 of the front cover 12 engages the outer edge 30 and binding 34 of the third cover 26 in a supporting manner to form a triangle between the front cover 12, the back cover 20, and the third cover 26. Once positioned, the stabilizing sheet 38 is flipped so as to engage the outer surface of the front cover 12. The stabilizing sheet 38, which extends down the outer surface of the front cover 12, provides support that prevents the outer edge 14 of the front cover 12 from sliding up over the third cover 26 and over the binding 34 causing the triangle formation to collapse. To fully stabilize the book's propped position (built-in bookstand) in a preferred embodiment, so that it cannot collapse, an elastic member 45 that preferably is a rubber band is placed around the front cover 12 and stabilizing or plastic sheet 38 so that they remain unified. In an alternative embodiment Velcro™ is utilized on the front cover and stabilizing sheet to connect the two together. The width of the spine 18 affects the angle of the propped position and the ease of reading. Thus, preferred is that the width of the spine 18 be greater than the width of fold-line 32.

Additionally, the third cover 26 has a stop 46 that is positioned on the surface of the third cover 26 away from the pages 36 such that the outer edge 14 of the front cover 12 engages the stop 46 in a propped position. The stop 46 is a groove or projection formed to engage edge 14.

The book 10 can also be read without using its built-in bookstand. This is made possible by adding an extra joint 48 on the back cover 20 of a preferred embodiment. The extra joint 48 allows the front cover 12, spine 18, and small portion of the back cover 50 to fold inward at this extra joint 48 until all of the three book covers 12, 20, 26 lie against each other, with the front cover 12 extending a few inches beyond the other two covers 20, 26.

The book 10 is then placed on a flat surface so that the pages 36 and stabilizing sheet 38 can be rotated 180 degrees over the wire binding 34 to lie apart from the covers 12, 30, 26. The stabilizing sheet 38 is rotated 180 degrees back again until it lies flat against the covers 12, 20, 26. The elastic member or rubber band 45, is then placed around the three book covers 12, 20, 26 and the plastic sheet 38, unifying them together. The book's pages 36 are then rotated 180 degrees so that they lie against these unified components 12, 20, 26, 38. The book 10 is now ready to read in its non-propped position. With the reader in a sitting position, she/he can hold the book's sides with both hands, with the bottom of the front cover 12 resting against the reader's thighs, the book's sides with both hands, with the bottom of the front cover 12 resting against the reader's thighs, hips, or belly. Hands can be freed by also resting the back of the book against the edge of a table or desk.

In another embodiment, the outer edge 14 of the front cover 12 includes an extension 15 which extends perpendicularly downwardly from the outer edge 14 of the front cover 12 at a 90° angle in the book's 10 closed position by a fold line 17. In the book's 10 closed position, the extension 15 is adjacent to the outer edges of the book's pages 36 on the edges of the pages 36 opposite the binding 34 and spine 18, hiding the pages 36 from view wherein the end 19 of the extension 15 is adjacent to and touches the inner edge 28 of the third cover 26. The width of the extension 15 is determined by the total thickness and number of pages 36 included in the book 10. The angle defined by the front cover 12 and the extension 15 does not exceed 90 degrees; however, in a preferred embodiment the angle of the extension 15 flexes inwardly by 20-30 degrees toward the front cover 12 to permit a flush attachment between the extension 15 and the third cover 26 when the book 10 is propped. In a preferred embodiment at least one Velcro™ attachment 21 is attached to the outer surface of the extension 15, and at least one complimentary Velcro™ attachment 21 is secured to the back of the third cover 26 adjacent to and just below where the third cover connects to the binding 34. Preferably, two or more complimentary Velcro™ attachments 21 approximately ½ inch in diameter are attached to the outer surface of the extension 15 and the back of the third cover 26. In order for a user to prop the closed book 10 up, the user lifts the front cover 12, and while holding the front cover 12 erect, the third cover 26 with the pages 36 lying upon the third cover 26 is lifted. The third cover 26 and front cover 12 are moved toward each and the third cover 26 to be placed upon the extension 15 of the erect front cover 12 such that the Velcro™ attachments 21 of the extension 15 mate with and adhere to the complimentary Velcro™ attachments 21 placed on the outside surface of the third cover 26. The propped book 10 is now ready to read.

Other Embodiments

Figure 5:
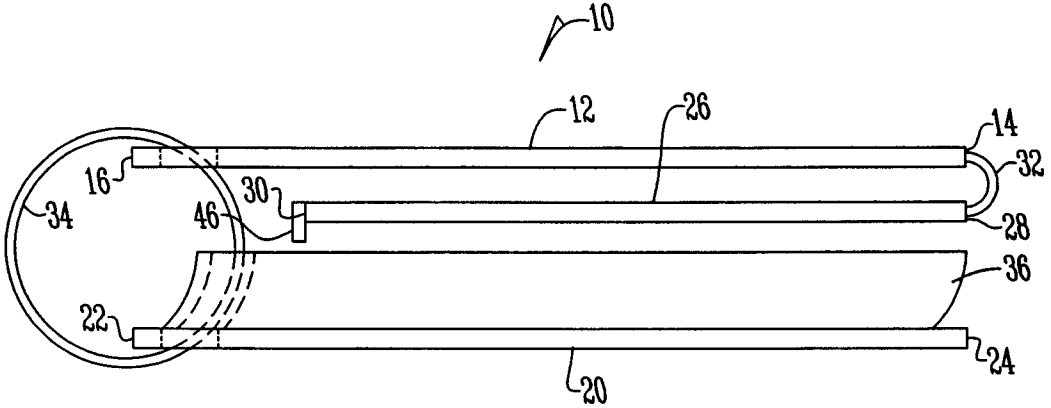
FIG. 5 is an elevational view of a second embodiment of a book in a closed position.
Figure 6:
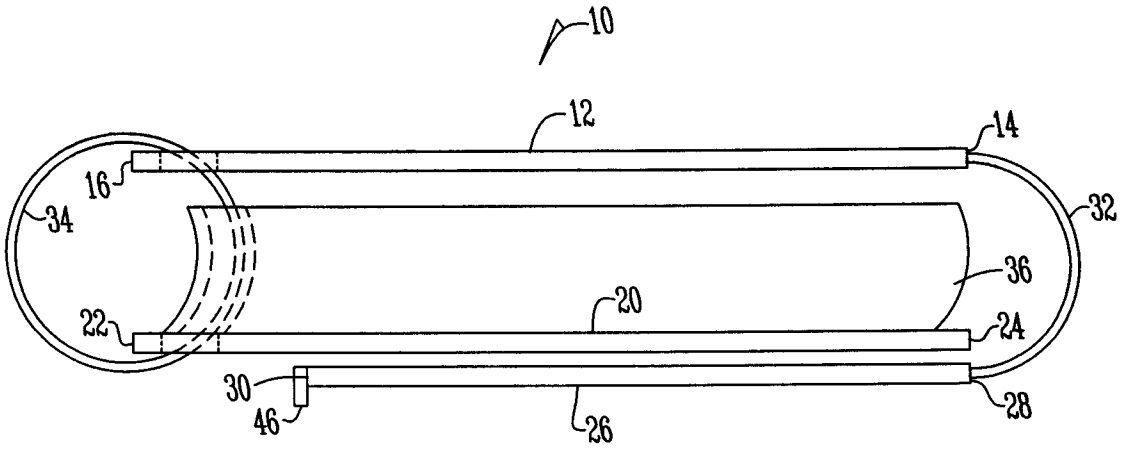
FIG. 6 is an elevational view of a second embodiment of a book in a closed position.
Figure 7:
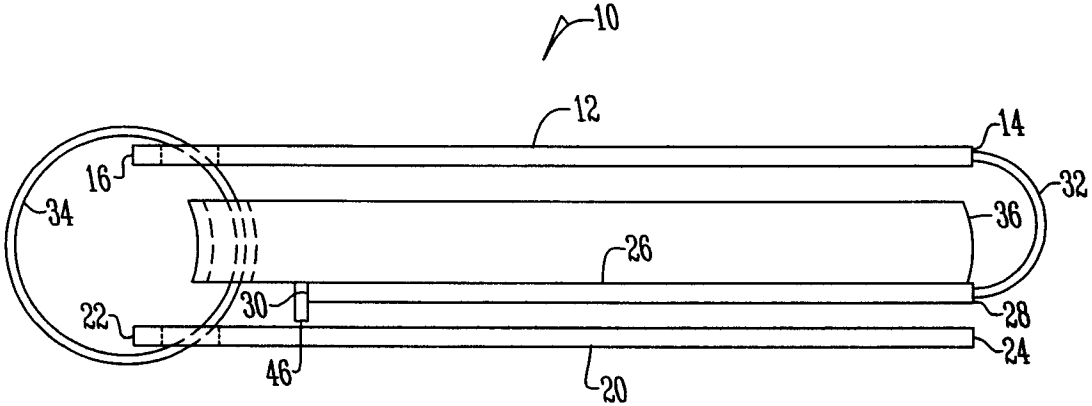
FIG. 7 is a closed elevational view of a second embodiment of a book in a closed position.

In a second embodiment, (with reference to FIGS. 5, 6 and 7) the front cover 12 and back cover 20 are connected by binding 34, and the third cover 26 is connected to the front cover 12 by fold-line 32. In a closed position, the pages 36 are attached to binding 34 and are positioned between front cover 12 and back cover 20. The third cover 26 is folded inwardly and permits the title of the book and/or author's name to be printed on the fold-line 32. A stop 46 is attached to the third cover 26 and faces the back cover 20 when in a closed position. Alternatively, stop 46 faces away from back cover 20 when in a closed position. In one example with reference to FIG. 5, in a folded position front cover 12 sits on top of the third cover 26 which is positioned between the front cover 12 and the pages 36. In this example fold line 32 is narrow, as the fold line merely connects front cover 12 and third cover 26 which fold upon one another. In another example with reference to FIG. 6 in a folded position, the back cover 20 sits on top of the third cover 26, that is back cover 20 is positioned between pages 36 and third cover 26. In this example fold line 32 is wider than in the above example (of FIG. 5) as the fold line 32 wraps around the front edges of pages 36 allowing the third cover 26 to be positioned outside of the back cover 20. This wider fold line 32 provides additional room for printing of indica such as title, author and the like. In yet another example, with reference to FIG. 7, in a folded position, third cover 26 is positioned between pages 36 and back cover 20. In this example the fold line is wider than the example of FIG. 5 but is slightly narrower than the example of FIG. 6 as the third cover is positioned between pages 36 and back cover 20. This example provides ample room for printing of indicia such as title, author and the like as in the previous example.

Figure 8:
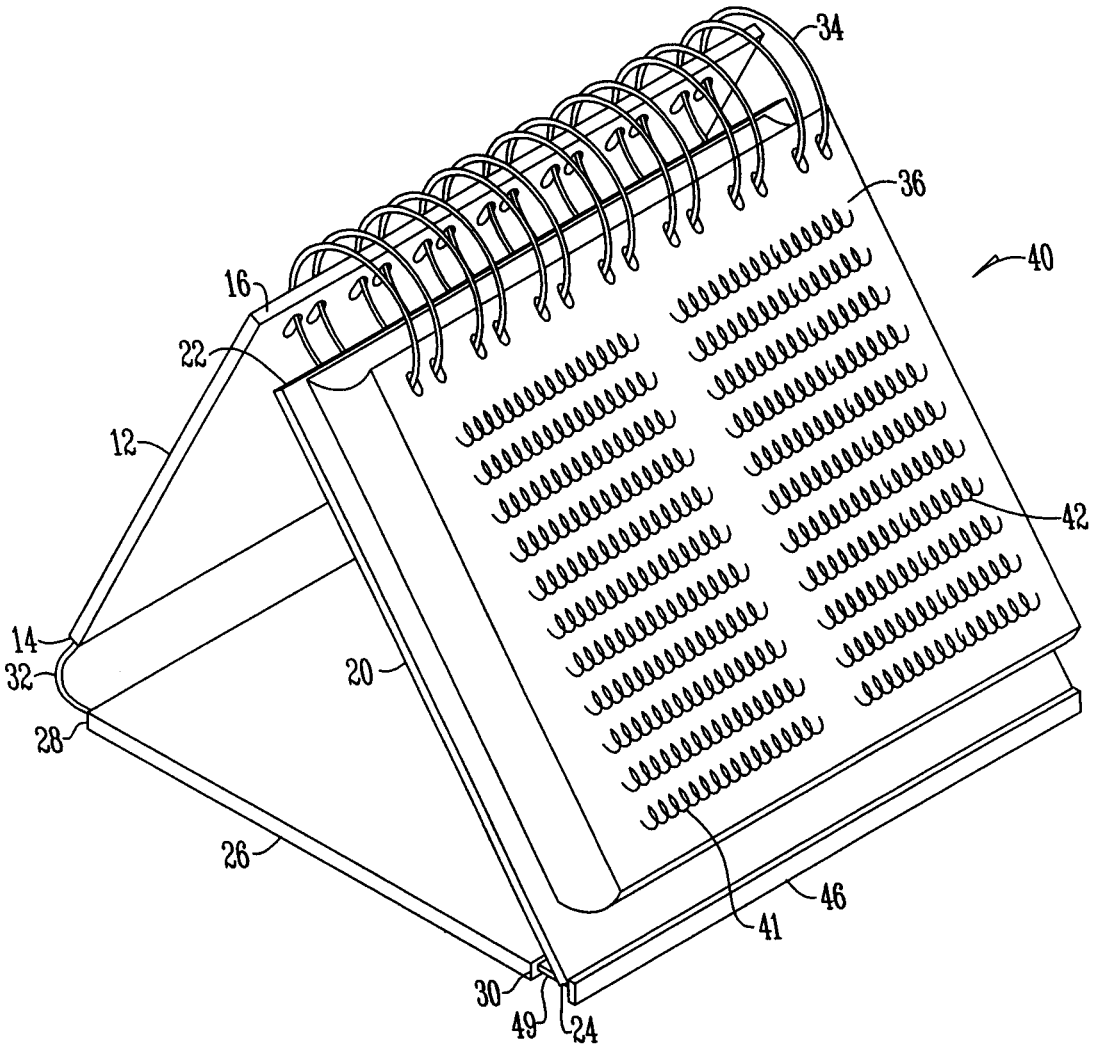
FIG. 8 is a perspective view of a third embodiment of a book in propped-up position.
Figure 9:
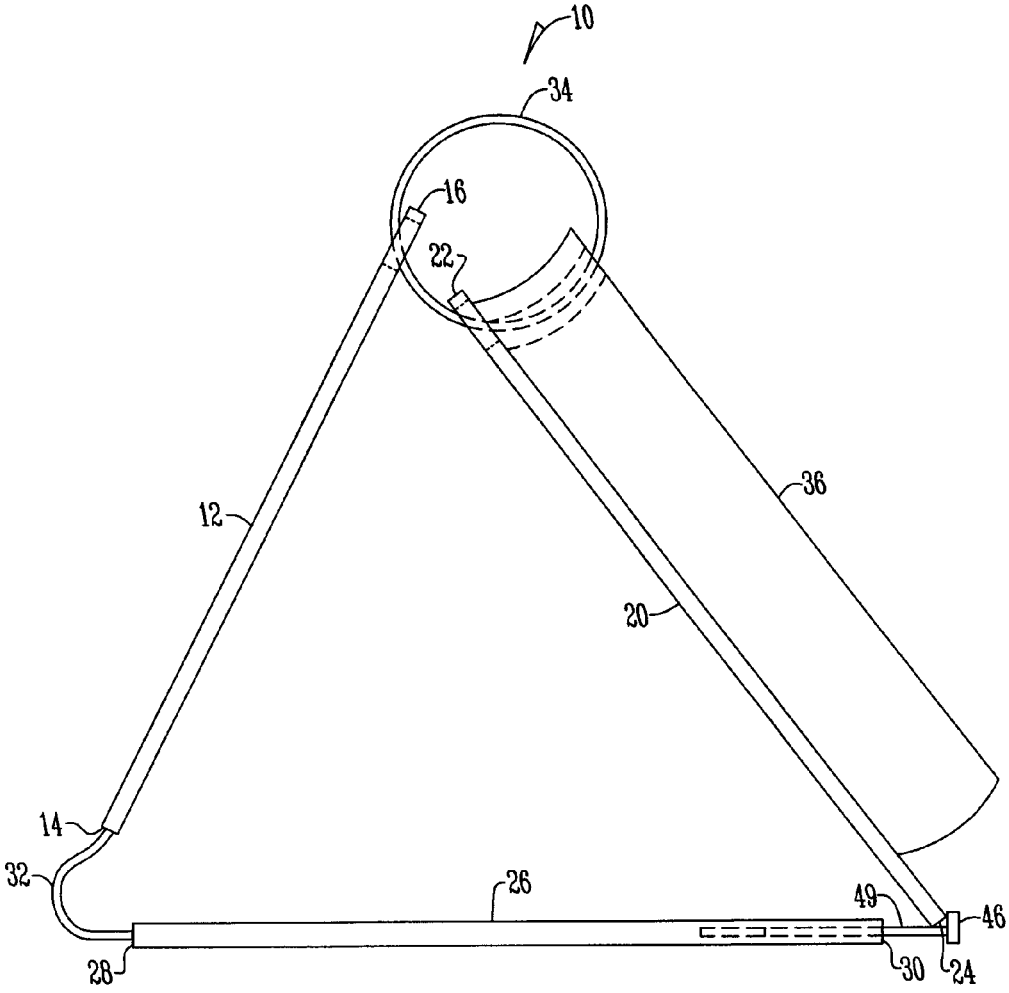
FIG. 9 is an elevational view of a third embodiment of a book in propped-up position.
Figure 10:
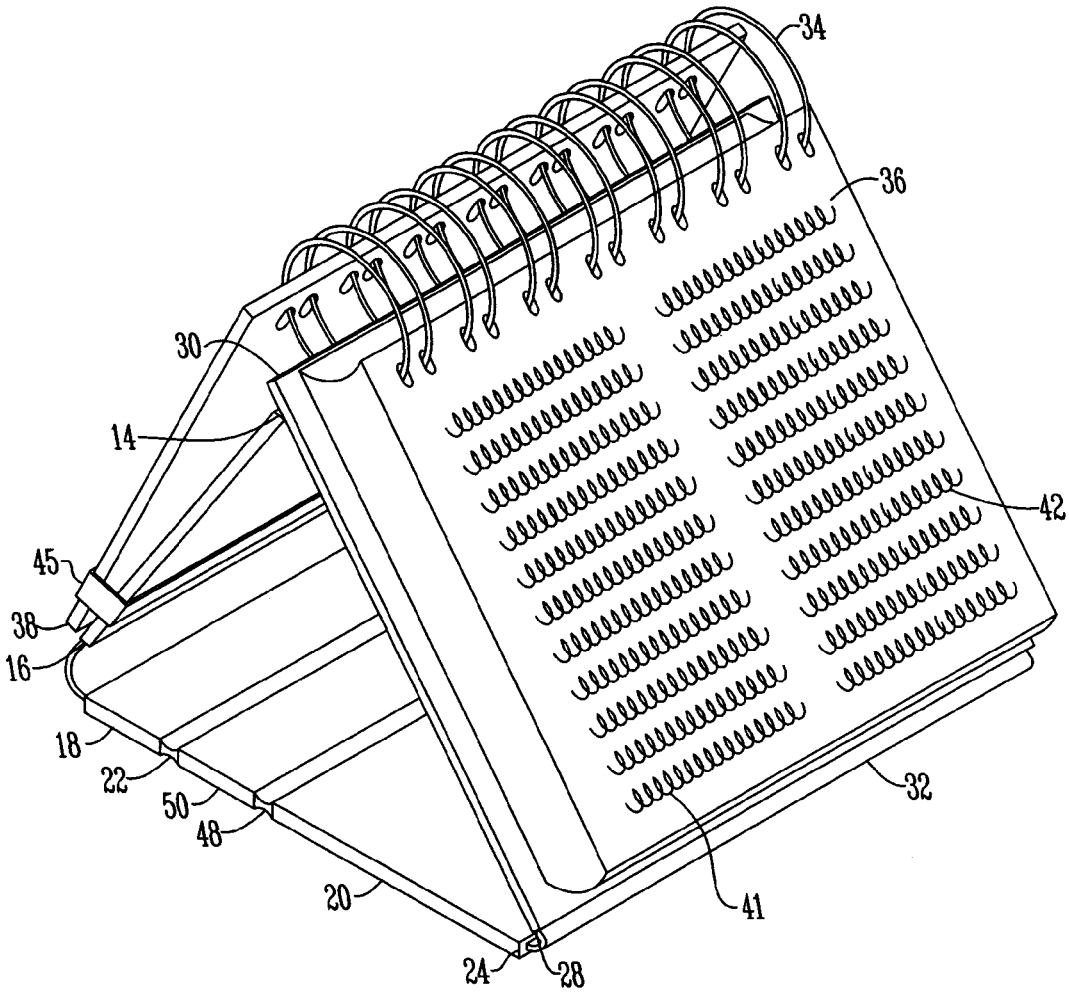
FIG. 10 is a perspective view of an embodiment of a book in a propped position.
Figure 11:
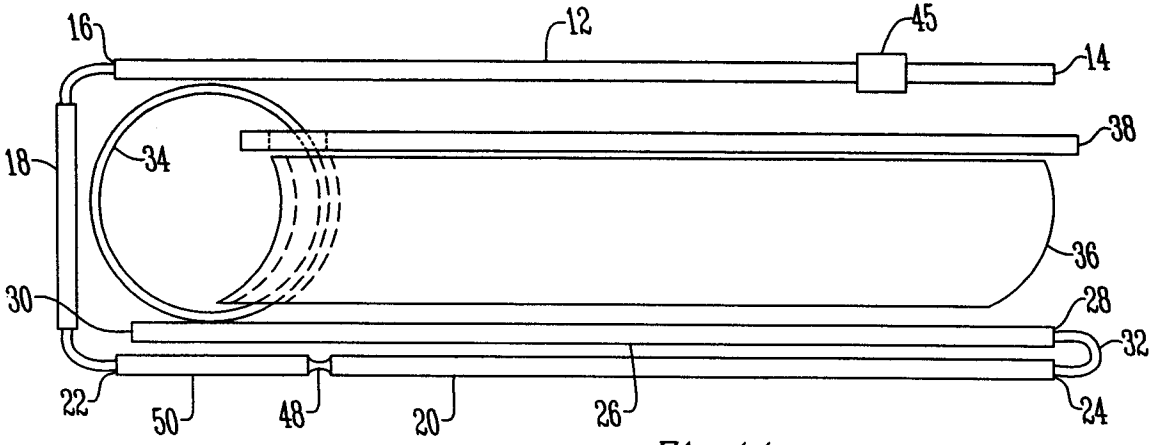
FIG. 11 is a side plan view of an embodiment of a book in a closed position.
Figure 12:
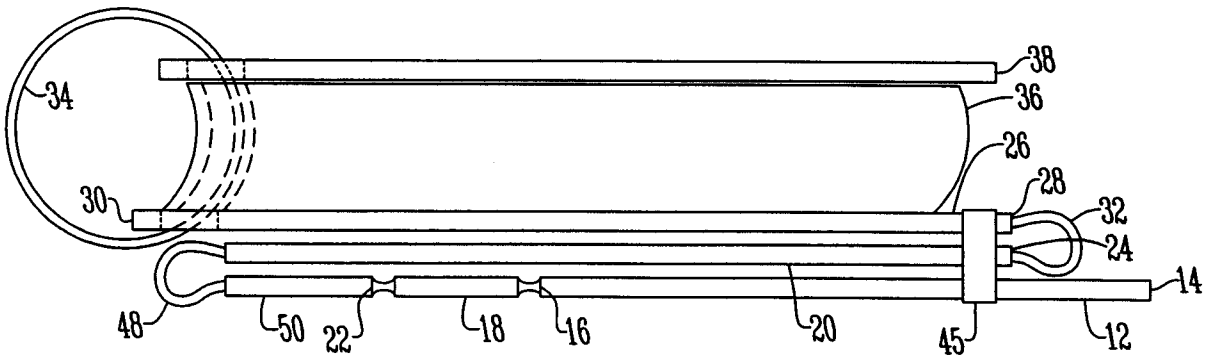
FIG. 12 is a side plan view of an embodiment of a book in an open position.

In a third embodiment, (with reference to FIGS. 8 and 9), the third cover 26 has an extendible flap 49 to which the stop 46 is attached. This extendible flap 49 moves between an extended position and a non-extended position which is flush with third cover 26. Stop 46 protrudes in width from the width of third cover 26, either towards pages 36, away from pages 36 or both towards and away from pages 36. Alternatively, stop 46 is flush in width with third cover 26 and therefore only protrudes when in an extended position from third cover 26 by the narrower extendible flap 49.

To move to second and third embodiments from a closed position (as reflected in FIGS. 5, 6 and 7) to a propped position (as reflected in FIGS. 8 and 9) the front cover 12 and third cover 26 are folded outwardly away from pages 36. The third cover 26 is then folded underneath such that the outer edge 24 of the back cover 20 engages stop 46 for a triangle between the front cover 12, back cover 20, and third cover 26 as well as provide support.

Figure 13:
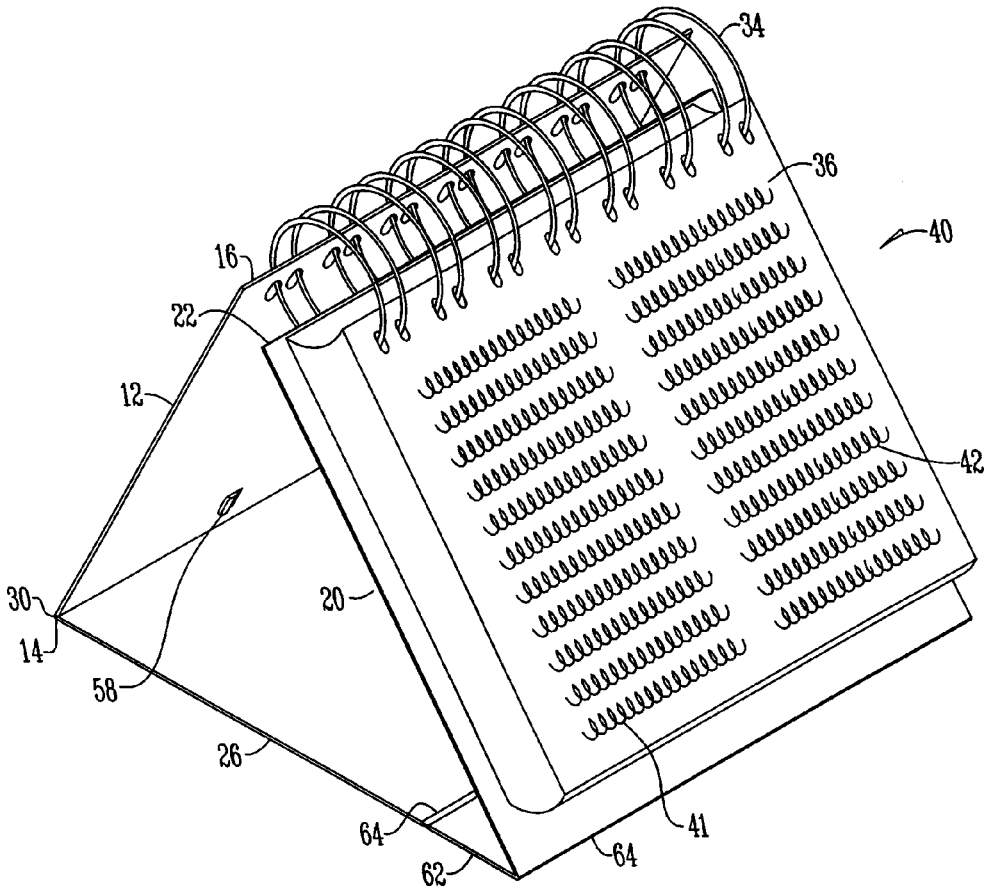
FIG. 13 is a perspective view of an embodiment of a book in a propped position.
Figure 14:
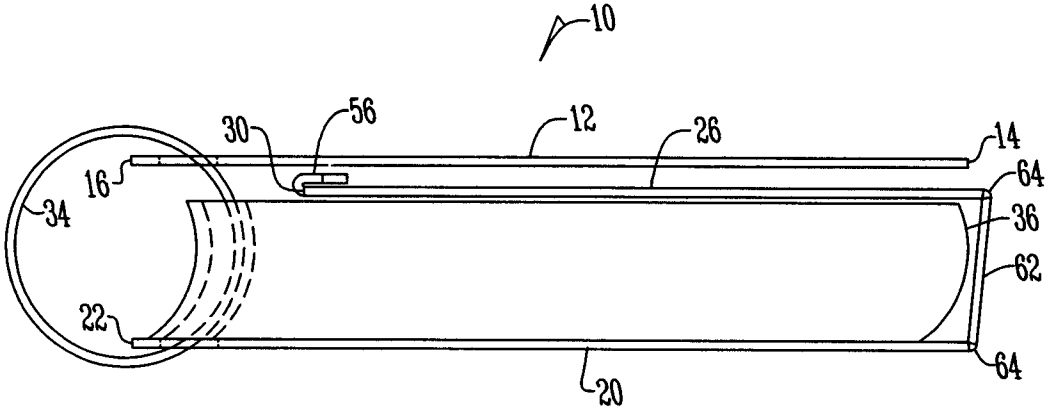
FIG. 14 is a side plan view of an embodiment of a book in an open position.
Figure 15:
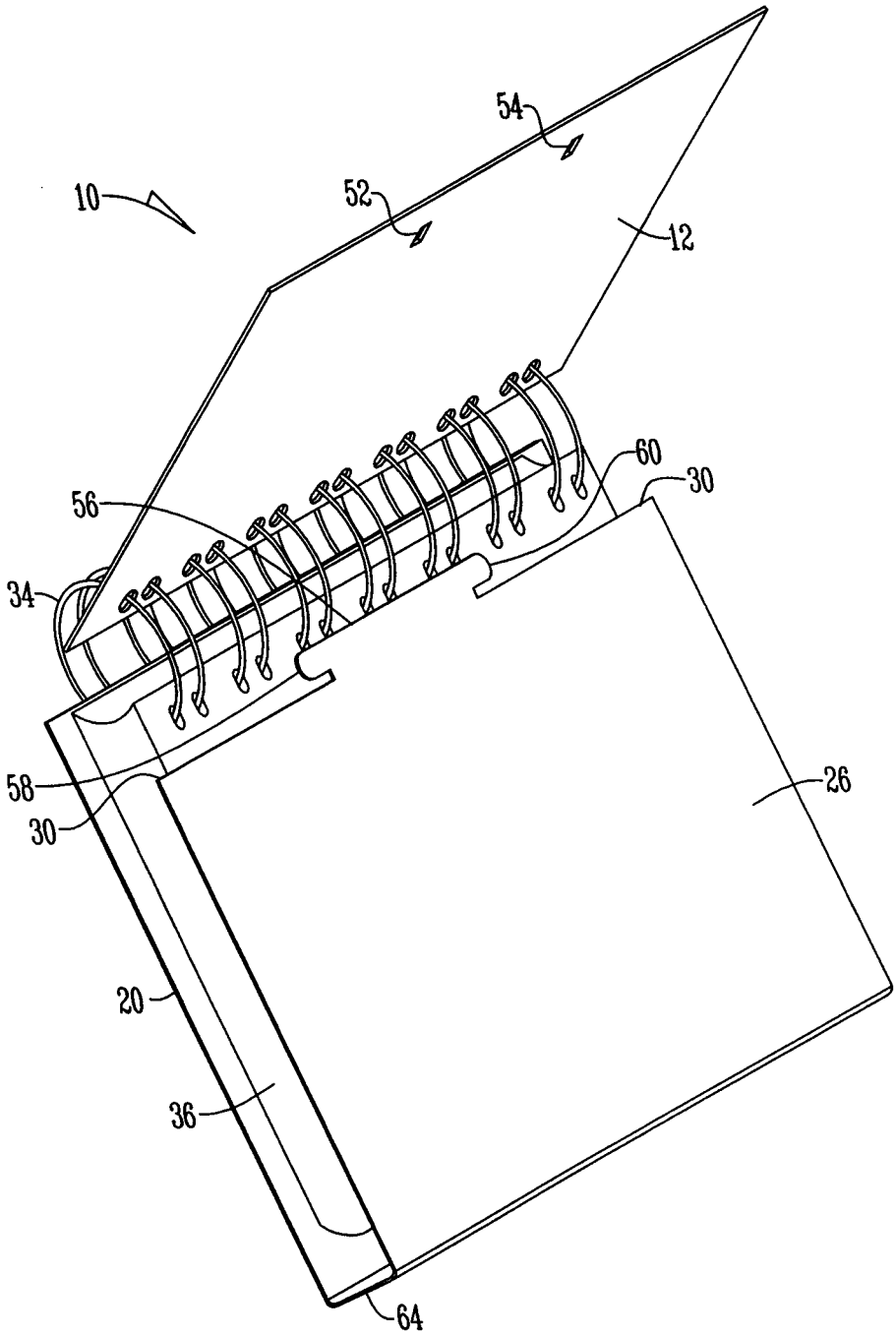
FIG. 15 is a perspective view of an embodiment of a book in a partially open position.

In a fourth embodiment as shown in FIGS. 13, 14, and 15 the book 10 is provided for a soft cover (paperback) book. In this embodiment the book 10 has the front cover 12, back cover 20 and third cover 26 wherein the stabilizing sheet has been eliminated. In this embodiment the front cover 12 is rotatably connected to the binding 34 at one end and has first and second openings 52 and 54 at a second end. The third cover 26 meanwhile has a foldable flap 56 that extends past outer edge 30 of the third cover 26 and has two oppositely disposed tabs 58 and 60 that fit within the openings 52 and 54 of the front cover 12. Specifically, the foldable flap 56 extends beyond edge 30 the third cover 26 and the tabs 58 and 60 align with the openings 52 and 54 of the front cover 12. Thus, when propping the book, the tabs 58 and 60 are placed in the openings 52 and 54 in order to interlock the front cover 12 with the third cover 26 in order to form a stand (propped position). The binding 34 of the fourth embodiment is O-wire or spiral coil binding that is of size and shape to support a page 36 in an upright position, if so desired. The wire curve of the O-wire binding 34 and punch holes work in unison to provide leverage that causes a page 36 with sufficient rigidity to suspend upright.

In operation, in the fourth embodiment when the book 10 is laying face up on a desk or tabletop a user opens the front cover 12 and lays it flat to the left. The third cover 26 is then opened from on the pages 36 and laid flat to the right. At that time the user picks up the entire book 10 and rotates the third cover 26 and front spine 62 at the crease 64 which joins the front spine 62 and the back cover 20 and places the third cover 26 and front spine 62 on the table. An outside edge 14 of the front cover 12 is then placed against the crease formed by the third cover 26 and the foldable flap 56. The tabs 58 and 60 of the foldable flap 56 are placed into the openings 52 and 54 of the front cover 12. The book 10 is then completely secured in its propped position and ready to use.

The print on the pages 36 in this embodiment are to be in a landscape position, preferably in two columns. Once the user has read a page 36, the page 36 is rotated fully over the binding to the other side of the propped formation or rotated only about 180 degrees so that the page stands upright fairly straight, suspended by the binding 34 on or about the same plane, or less, as the other pages below. The page 36 then stands up against the binding 34 to be in a position for reading. Once the suspended page is read the user can push the page 36 over so that it falls to the other side of the book. Suspension of the page is made possible because of the size and rigidity of the page 36 as compared to the binding 34. In a mass market paperback size (6.8-7.5"×4.12-4.25"), standard 20 pound weight paper is presented. Thus, with suspension a user does not have to constantly rotate the book as in other embodiments.

Trade paperback size books (8.5-9"×5.5-6") in this embodiment, due to their greater page width, require heavier, thus stiffer, paper in order to provide adequate suspension. In one embodiment a greater than 20 pound paper weight is provided to make possible adequate suspension of the page against the binding 34.

Thus, a book has been disclosed that at the very least meets the stated objectives.

What is claimed is:

1. A book comprising:

a front cover connected to a back cover by a binding;

pages connected to the binding;

a third cover connected to the back cover by a front spine;

a foldable flap connected to the third cover;

wherein the front cover is placed against the foldable flap when the book is in a propped position and the front cover interlocks with the third cover such that a stand is formed to support the book in a propped position.

* * * * *